United States Patent [19]

Moss

[11] 4,141,579

[45] Feb. 27, 1979

[54] LITTER RETRIEVING DEVICE

[76] Inventor: Thomas Moss, P.O. Box 11792, Houston, Tex. 77039

[21] Appl. No.: 855,806

[22] Filed: Nov. 29, 1977

[51] Int. Cl.[2] ..... B08B 1/00

[52] U.S. Cl. ..... 294/61

[58] Field of Search ..... 294/14, 17, 19 R, 22, 294/26, 50, 50.6, 50.7, 55.5, 61, 110 A, 125, 126; 43/5, 6; 119/151, 152

[56] References Cited

U.S. PATENT DOCUMENTS

| | | | |
|---|---|---|---|
| 852,309 | 4/1907 | Welch | 294/22 |
| 1,168,126 | 1/1916 | Symes | 294/26 X |
| 1,468,878 | 9/1923 | Donald | 294/22 |
| 1,483,445 | 2/1924 | Holton | 294/61 |
| 2,794,667 | 6/1957 | Bissitt | 294/61 X |
| 2,989,334 | 6/1961 | Browne | 294/61 X |
| 3,105,715 | 10/1963 | Happ | 294/61 |
| 3,579,894 | 5/1971 | Kidder | 43/6 |
| 3,712,660 | 1/1973 | Moore | 294/61 |

*Primary Examiner*—Johnny D. Cherry
*Attorney, Agent, or Firm*—Armstrong, Nikaido, Marmelstein & Kubovcik

[57] ABSTRACT

A litter retrieving device for retrieving both containers and flat articles is provided. The litter retrieving device includes a handle, a semi-cylindrical element, a flanged lip and a plurality of piercing elements. The semi-cylindrical element is attached to an end of the handle. The flanged lip is formed as an extension along a side of the semi-cylindrical element. Piercing elements are provided both on the inner periphery of the semi-cylindrical member and on a lower side of the flanged lip. The semi-cylindrical element is adapted to encircle and restrain the containers as the piercing element located on the inner periphery of the semi-cylindrical member penetrates the containers. The piercing elements on the flanged lip are adapted for piercing flat articles.

6 Claims, 3 Drawing Figures

LITTER RETRIEVING DEVICE

BACKGROUND OF THE INVENTION

1. Field of the Invention

The present invention is directed to a litter retrieving device and in particular to a litter retrieving device which is especially adapted for restraining and retrieving containers and also for retrieving flat articles in a very simple and efficient manner without the use of moving parts.

2. Description of the Prior Art

Litter retrieving devices, of relatively complex construction, that is, including telescoping shaft members and manually actuated pick-up tools, such as tongs or gripping fingers and pointed rods or spikes, are known in the art. Examples of such devices are disclosed in the following patents:

Gauntlett — U.S. Pat. No. 830,061 — Sept. 4, 1906
Happ — U.S. Pat. No. 3,105,715 — Oct. 1, 1963
Foust — U.S. Pat. No. 3,873,143 — Mar. 25, 1975
Bissitt — U.S. Pat. No. 2,794,667 — June 4, 1957
Browne — U.S. Pat. No. 2,989,334 — June 20, 1961
Moore — U.S. Pat. No. 3,712,660 — Jan. 23, 1973

Browne discloses a bottle and can lifter which grips a can as opposed to puncturing it. Also disclosed is a retractable rod having a pointed lower end, but the pointed end is not used in conjunction with the can gripping member.

Bissitt discloses a paper retrieving device having two modes of operation; one for retrieving paper from a soft surface and another for retrieving paper from a hard surface, such as concrete. In the first mode of operation a double sleeve is released and moved upwardly along a rod until the end portions of a plurality of fingers are substantially flush with a flanged element. A handle is then manipulated to lock the double sleeve to the rod, thereby precluding relative motion therebetween. A pointed end then extends beyond the flange and may thus be used to pierce paper on the soft ground surface. After the paper has been retrieved, the pointed end is retracted and the paper is released. In the second mode of operation, the end portions are spread apart. The end portions are then placed over the paper to be retrieved and the handles are moved in relation to each other thereby retracting the spring fingers and bringing a bulge portion into the openings provided in the flange, wherein the end portion of the fingers are moved towards each other into a gripping relation.

Foust discloses a pick-up device which includes a pair of looped gripping fingers for grabbing and releasing objects such as bottles and cans, and which may optionally also include a pointed tool telescopically received within a tubular body. When the pointed tool is in its protracted position, the gripping fingers are in their closed position for gripping an object. Upon pushing a release button the latch fingers are released, thereby retracting the pointed tool and extending or flattening a pair of toggles, thereby opening or separating the gripping fingers to release an object being gripped.

Happ discloses a pick-up device which may be used alternately to stab pieces of paper or to grip cans. The gripping member, however, does not serve to locate and position an item that is to be stabbed by the pointed member.

Moore discloses a hand-held litter retrieving device which provides a choice of three different operating modes. A first mode is provided wherein a bottle or can is gripped by a plurality of spaced fingers. In this first mode a puncturing member is held in a retracted position. In a second mode of operation the device is placed above a piece of litter with the tips of the fingers resting on and holding the litter in place. A detent is then actuated for releasing the litter puncturing member which then drops, thereby driving the puncturing member into the litter. The sole force for driving the puncturing member into the litter is the weight of the puncturing assembly including an elongated reciprocal rod and the puncturing member. In a third mode of operation, the detent is actuated, thereby allowing the puncturing member to fall until the detent engages in a groove. The puncturing member is then held in a position such that it can be impaled upon the litter without having the tips of the fingers touch the litter. Therefore, none of the three modes set forth in Moore disclose a device which operates in as simple and efficient a manner as the subject invention.

Gauntlett discloses a cigarette holder that includes curved guiding jaws and a fixed tick located therebetween. Gauntlett, however, does not disclose a flanged lip formed as an extension along a side of the semi-cylindrical member supporting a piercing element.

Thus, as pointed out above, the prior art devices are of relatively complex construction with a large number of interacting moving components which construction makes these prior art devices expensive to manufacture and which further lends them to mechanical malfunctioning, and expensive preventive maintenance. Still further, the prior art devices are complicated and difficult to operate.

SUMMARY OF THE INVENTION

It is an object of the present invention to provide a litter retrieving device which includes a semi-cylindrical element for encircling and restraining a container as a piercing element located on the inner periphery of the semi-cylindrical member penetrates the container.

It is another object of the present invention to provide a litter retrieving device which is formed as a single unitary structure without moving parts, which thus operates in a simple and efficient manner, is not susceptible to malfunction and which is inexpensive to manufacture.

It is still a further object of the present invention to provide a litter retrieving device which is both useful for retrieving containers and also for retrieving flat articles.

It is still another object of the present to provide a litter retrieving device which can retrieve both containers and flat articles, which requires no adjustment or realignment of the device when switching between the two types of operation and in which the components for retrieving containers in no way interfere with the elements for retrieving flat articles, and vice-versa.

The present invention is directed to a litter retrieving device for retrieving both containers and flat articles which comprises a handle, a semi-cylindrical element, a flanged lip and a plurality of piercing elements, the semi-cylindrical element being attached to an end of the handle, and the flanged lip being formed as an extension along a side of the semi-cylindrical element. Piercing elements are provided both on the inner periphery of the semi-cylindrical member and on a lower side of the flanged lip. The litter retrieving device is formed of a unitary construction and further includes a transitional inlet located between the flanged lip and an edge of the semi-cylindrical element. The semi-cylindrical element is adapted to encircle and restrain containers as the piercing elements located on the inner periphery of the semi-cylindrical member penetrate the containers. The piercing elements on the flanged lip are adapted for piercing flat articles.

DETAILED DESCRIPTION OF THE PREFERRED EMBODIMENT

Figure 1:
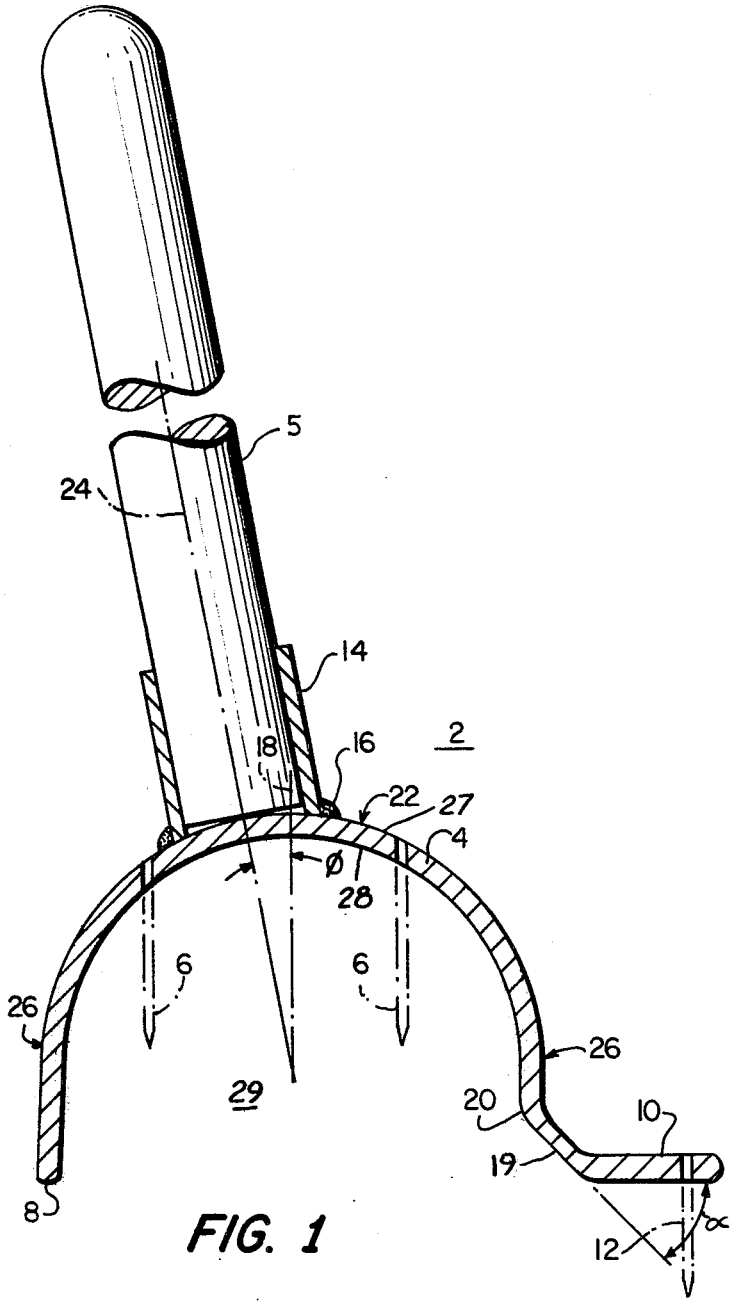
FIG. 1 is a sectional side elevation view through line I—I in FIG. 2, showing a litter retrieving device of the present invention.
Figure 2:
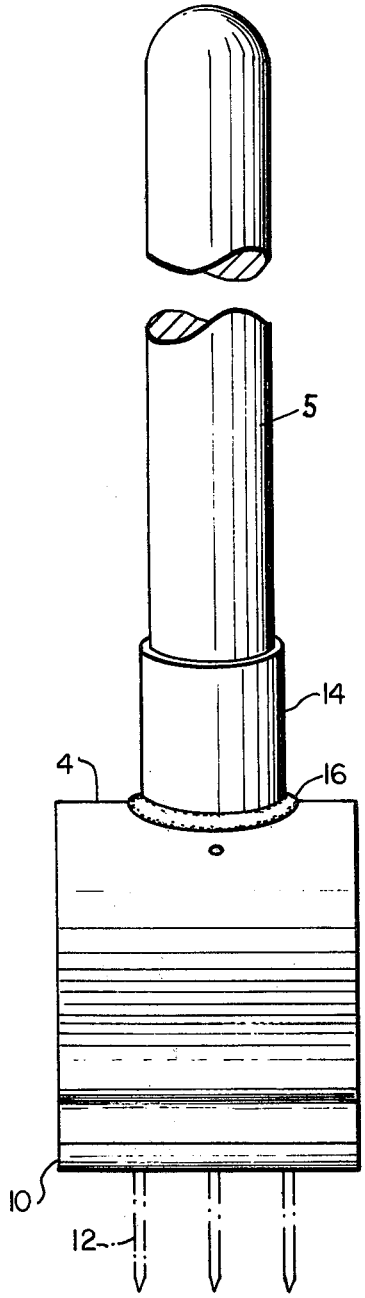
FIG. 2 is a top plan view of a litter retrieving device of the present invention.
Figure 3:
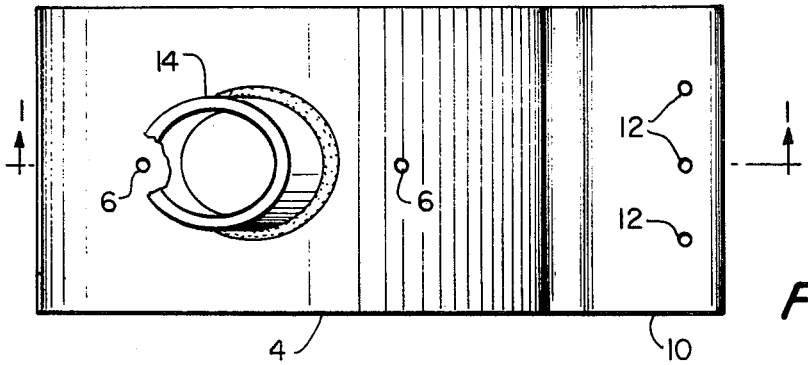
FIG. 3 is a front elevation view of a litter retrieving device of the present invention.

Referring to the drawings, litter retrieving device 2 includes a semi-cylindrical element 4 and a handle 5. The semi-cylindrical element 4 includes one or more piercing elements 6 located within the inner periphery of the semi-cylindrical element. The piercing elements 6 are recessed from the bottom most open edges 8 and 20 of the semi-cylindrical element.

A flanged lip 10 is provided as an extension along a side of the semi-cylindrical element. The flanged lip 10 includes one or more piercing elements 12 which extend below the lower most edges 8 and 20 of the semi-cylindrical element.

The handle 5 is attached to the semi-cylindrical member 4 by a tubular flange 14 attached to the outer periphery of the semi-cylindrical member by, for example, a weldment 16. The handle 5 is inserted in the opening formed by the tubular flange 14.

The handle 5 and the flange 14 are positioned on the outer periphery of the semi-cylindrical element such that their longitudinal axis 24 is positioned at an angle from a radius line 18 passing through the upper most portion of the semi-cylindrical element. The angle $\phi$ between the longitudinal axis 24 and the radius line 18 is approximately 10 degrees.

A transitional inlet 19 located intermediate the flanged lip 10 and the lower most edge 20 of the semi-cylindrical member makes a transition between the flanged lip and the semi-cylindrical member. The transitional inlet is formed such that the angle $\alpha$ is approximately 45°.

It will be noted that the semi-cylindrical element 4 comprises an arcuate upper portion 22 including an outermost surface 27 and an inner concave surface 28 defining an interior portion 29, and a pair of generally vertically extending lower portions 26,26.

In operation, when it is desired to retrieve a semi-rigid container, the operator holding the handle merely places the semi-cylindrical element over the container and the container is thus immediately and automatically entrapped by the semi-cylindrical element without any mechanical manipulation by the operator. The transitional inlet 19 facilitates the entry of the container within the semi-cylindrical member 22. The container is now entrapped by the lower portions 26,26 such that as the litter retriever 2 is thrust against the container, the piercing elements 6 penetrate the container without any possibility of the container slipping away from the piercing elements. The angle of the handle makes it easier to retain the container when chasing the container, rather than applying a purely vertical force to puncture the container, as the force may be applied at a slight angle if the can is rolling. Further, when retrieving a flat article, such as a piece of paper, the piercing elements 12 located on the flange 10 penetrate the flat article without experiencing any interference from the container retrieving elements, thus the invention facilitates the retrieval of flat articles as well as containers with one unitary device of simple construction which requires virtually no maintenance.

The present invention may be embodied in other specific forms without departing from the spirit or essential characteristics thereof. The presently disclosed embodiments are therefore to be considered in all respects as illustrative and not restrictive, the scope of the invention being indicated by the appended claims. rather than the foregoing description, and all changes which come within the meaning and range of equivalency of the claims are, therefore, to be embraced therein.

I claim:

1. A litter retrieving device for retrieving both containers and flat articles comprising:

(a) a handle means in the form of an elongate rod having a longitudinal axis;

(b) a semi-cylindrical means, said semi-cylindrical means having an outer convex surface and an inner concave surface defining an interior portion, said elongate rod being attached at one end to said outer convex surface, said longitudinal axis extending along a radial line of said semi-cylindrical means approximately perpendicular to a tangent to said outer convex surface, an extension of said longitudinal axis passing through said interior portion of said semi-cylindrical means;

(c) a flanged lip formed as an extension along a side of said semi-cylindrical means;

(d) first piercing means located on the inner concave surface of said semi-cylindrical means;

(e) second piercing means located on said flanged lip, and first and second piercing means all lying in parallel planes; and (f) a transitional inlet means located between said flanged lip and an edge of said semi-cylindrical means, wherein said transitional inlet means is adapted to facilitate entry of said containers into said semi-cylindrical means;

wherein said semi-cylindrical means is adapted to encircle and restrain said containers as the first piercing means penetrates said containers and said second piercing means on said flanged lip is adapted to pierce said flat articles.

2. A litter retrieving device as claimed in claim 1 wherein said transitional inlet means is provided at an angle of 45° to the flanged lip.

3. A litter retrieving device as claimed in claim 1 wherein said handle means comprises a tubular flange attached to the outer periphery of said semi-cylindrical means, wherein said tubular flange secures said elongate rod to said semi-cylindrical means.

4. A litter retrieving device as claimed in claim 3, wherein said tubular flange has a longitudinal axis, said tubular flange being positioned at a position wherein said longitudinal axis is at an angle of approximately 10° from a radius line passing thru the uppermost portion of said semi-cylindrical means.

5. A litter retrieving device as claimed in claim 1 wherein said device is of a unitary construction.

6. A litter retrieving device as claimed in claim 1, wherein said semi-cylindrical means comprises an arcuate upper portion and generally vertically extending lower portions.

* * * * *